US008955603B2

(12) United States Patent
Ravensbergen et al.

(10) Patent No.: US 8,955,603 B2
(45) Date of Patent: Feb. 17, 2015

(54) SYSTEM AND METHOD FOR POSITIONING A BOTTOM HOLE ASSEMBLY IN A HORIZONTAL WELL

(75) Inventors: John Edward Ravensbergen, DeWinton (CA); Lyle Laun, Calgary (CA); John Misselbrook, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 589 days.

(21) Appl. No.: 13/030,335

(22) Filed: Feb. 18, 2011

(65) Prior Publication Data

US 2012/0160516 A1 Jun. 28, 2012

Related U.S. Application Data

(60) Provisional application No. 61/427,442, filed on Dec. 27, 2010.

(51) Int. Cl.
*E21B 23/00* (2006.01)
*E21B 23/02* (2006.01)
(Continued)

(52) U.S. Cl.
CPC ..... *E21B 23/02* (2013.01); *E21B 43/14* (2013.01); *E21B 47/0905* (2013.01); *E21B 34/103* (2013.01); *E21B 47/0915* (2013.01)
USPC ..... 166/380; 166/64; 166/242.1; 166/242.6; 166/255.1; 166/255.2

(58) Field of Classification Search
CPC ... E21B 23/02; E21B 34/103; E21B 47/0915; E21B 47/0905; E21B 43/14
USPC ..... 166/255.1, 255.2, 64, 380, 242.1, 242.6
See application file for complete search history.

(56) References Cited

U.S. PATENT DOCUMENTS 2,187,483 A 1/1940 Baker
2,189,702 A 2/1940 Burt
(Continued)

FOREIGN PATENT DOCUMENTS

CA 2210103 A1 5/1998
CA 2322075 A1 4/2001
(Continued)

OTHER PUBLICATIONS

International Search Report & Written Opinion dated Apr. 25, 2013 issued in PCT/US2011/066185.
(Continued)

*Primary Examiner* — Jennifer H Gay
*Assistant Examiner* — George Gray
(74) *Attorney, Agent, or Firm* — Parsons Behle & Latimer

(57) ABSTRACT

A system of couplings and method of use of the couplings to locate a downhole tool connected to coiled tubing, such as a bottom hole assembly, within a selected segment of a casing string. The selected segment of casing may be a ported collar or ported housing that permits the treatment and/or stimulation of the adjacent well formation. The system of couplings may be two, three, or four couplings spaced apart at predetermined lengths. The predetermined lengths may be shorter than typical lengths of casing segments. The distance between the first and second coupling may be substantially identical to the distance between the third and fourth coupling. The use of distances between the couplings that are shorter than the length of conventional casing segments may provide surface indicators as to the location of the bottom hole assembly with a higher confidence than relying on a traditional tally sheet.

37 Claims, 6 Drawing Sheets

(51) Int. Cl.

| | |
|---|---|
| ***E21B 43/14*** | (2006.01) |
| ***E21B 47/09*** | (2012.01) |
| ***E21B 34/10*** | (2006.01) |

(56) References Cited

U.S. PATENT DOCUMENTS

| | | | | |
|---|---|---|---|---|
| 2,307,662 | A | | 1/1943 | Baylor |
| 3,291,208 | A | * | 12/1966 | Kenneday ..... 166/254.2 |
| 4,044,470 | A | * | 8/1977 | Dufrene ..... 33/1 R |
| 4,088,191 | A | | 5/1978 | Hutchison |
| 4,257,484 | A | | 3/1981 | Whitley et al. |
| 4,260,017 | A | | 4/1981 | Nelson |
| 4,312,406 | A | | 1/1982 | McLaurin et al. |
| 4,330,039 | A | | 5/1982 | Vann et al. |
| 4,564,225 | A | * | 1/1986 | Taylor ..... 285/333 |
| 5,358,048 | A | | 10/1994 | Brooks |
| 5,417,291 | A | | 5/1995 | Leising |
| 5,443,124 | A | | 8/1995 | Wood et al. |
| 5,513,703 | A | | 5/1996 | Mills et al. |
| 6,024,173 | A | | 2/2000 | Patel et al. |
| 6,292,242 | B1 | | 9/2001 | Vanderploeg et al. |
| 6,513,595 | B1 | | 2/2003 | Freiheit |
| 6,832,654 | B2 | | 12/2004 | Ravensbergen et al. |
| 6,883,610 | B2 | | 4/2005 | Depiak |
| 7,066,264 | B2 | | 6/2006 | Bissonnette et al. |
| 7,124,824 | B2 | | 10/2006 | Turner et al. |
| 7,249,633 | B2 | | 7/2007 | Ravensbergen et al. |
| 7,387,165 | B2 | | 6/2008 | Lopez de Cardenas |
| 7,556,102 | B2 | | 7/2009 | Gomez |
| 7,748,463 | B2 | | 7/2010 | Revheim |
| 7,789,163 | B2 | | 9/2010 | Kratochvill et al. |
| 7,810,570 | B2 | | 10/2010 | Collins et al. |
| 7,823,633 | B2 | | 11/2010 | Hartwell |
| 7,861,774 | B2 | | 1/2011 | Fehr et al. |
| 7,861,788 | B2 | | 1/2011 | Tips et al. |
| 2003/0019628 | A1 | | 1/2003 | Ravensbergen |
| 2003/0127227 | A1 | | 7/2003 | Fehr |
| 2004/0238173 | A1 | | 12/2004 | Bissonnette et al. |
| 2005/0000693 | A1 | | 1/2005 | Ravensbergen |
| 2005/0072577 | A1 | | 4/2005 | Freeman |
| 2005/0126787 | A1 | | 6/2005 | Gomez |
| 2006/0000620 | A1 | | 1/2006 | Hamilton |
| 2006/0081380 | A1 | * | 4/2006 | Hoffman et al. ..... 166/381 |
| 2006/0124310 | A1 | | 6/2006 | Lopez de Cardenas |
| 2006/0231253 | A1 | | 10/2006 | Vilela et al. |
| 2007/0272411 | A1 | | 11/2007 | Lopez de Cardenas |
| 2008/0210431 | A1 | | 9/2008 | Johnson et al. |
| 2008/0236819 | A1 | | 10/2008 | Foster et al. |
| 2009/0014168 | A1 | | 1/2009 | Tips et al. |
| 2009/0044944 | A1 | | 2/2009 | Murray et al. |
| 2009/0084553 | A1 | * | 4/2009 | Rytlewski et al. ..... 166/305.1 |
| 2010/0089587 | A1 | | 4/2010 | Stout |
| 2010/0263873 | A1 | | 10/2010 | Turner |
| 2011/0155377 | A1 | | 6/2011 | Laun |
| 2011/0308817 | A1 | | 12/2011 | Ravensbergen |
| 2012/0111566 | A1 | | 5/2012 | Sherman et al. |

FOREIGN PATENT DOCUMENTS

| | | | |
|---|---|---|---|
| CA | 2385795 | A1 | 4/2001 |
| CA | 2397460 | A1 | 8/2001 |
| CA | 2375045 | A1 | 9/2002 |
| CA | 2381620 | A1 | 10/2002 |
| CA | 2392277 | A1 | 12/2002 |
| CA | 2535940 | A1 | 8/2006 |
| CA | 2623100 | A1 | 3/2007 |
| CA | 2559815 | A1 | 9/2007 |
| CA | 2622044 | | 9/2008 |
| CA | 2641778 | A1 | 4/2010 |
| CA | 2688106 | A1 | 7/2010 |
| CA | 2693676 | | 7/2010 |
| CA | 2670218 | | 12/2010 |
| CA | 2711329 | | 1/2011 |
| CA | 2738907 | | 7/2011 |
| EP | 0581533 | A2 | 2/1994 |
| WO | WO2004063527 | A1 | 7/2004 |
| WO | WO2007075855 | | 7/2007 |
| WO | WO2008091345 | A1 | 7/2008 |

OTHER PUBLICATIONS

Office Action issued in corresponding Canadian Patent Application No. 2,711,329, dated Mar. 17, 2011.

Office Action issued in Canadian Patent Application No. 2711329 and dated Sep. 6, 2011.

Office Action issued in Canadian Patent Application No. 2711329 and dated Mar. 19, 2012.

Protest filed on Feb. 10, 2012 in Canadian Patent Application No. 2711329.

Office Action dated Jun. 29, 2012 issued in Canadian Patent Application No. 2711329.

Office Action issued in Canadian Patent Application No. 2730695 dated Apr. 27, 2011.

Notice of Protest issued in Canadian Patent Application No. 2730695 dated Feb. 24, 2012.

Protest Filed Under S 34.1 in Canadian Patent Application No. 2730695 dated Feb. 23, 2012.

Protest filed on Aug. 16, 2012 in Canadian Patent Application No. 2730695.

Office Action dated Apr. 5, 2012 issued in Canadian Patent Application No. 2730695.

Protest Filed in CA Patent Application No. 2730695 dated Mar. 5, 2013.

Office Action dated Jan. 30, 2013 issued in Canadian Patent Application No. 2730695.

Office Action dated Sep. 25, 2012 issued in Canadian Patent Application No. 2781721.

Office Action dated Feb. 21, 2013 issued in Canadian Patent Application No. 2781721.

Office Action dated Aug. 6, 2013 issued in Canadian Patent Application No. 2781721.

International Search Report and Written Opinion dated Apr. 4, 2013 issued in PCT/US2011/065212.

International Search Report and Written Opinion dated Apr. 11, 2013 in PCT/US2012/051679.

European Office Action issued in EP Application No. 11808090.2-1610 dated Feb. 8, 2013.

Office Action dated Apr. 26, 2013, issued in Canadian Patent Application No. 2,797,934.

Office Action dated Aug. 27, 2013, issued in Canadian Patent Application No. 2,730,695.

* cited by examiner

SYSTEM AND METHOD FOR POSITIONING A BOTTOM HOLE ASSEMBLY IN A HORIZONTAL WELL

RELATED APPLICATIONS

The present disclosure claims benefit of U.S. Provisional Patent Application No. 61/427,442 entitled "System and Method for Positioning a Bottom Hole Assembly in a Horizontal Well", filed on Dec. 27, 2010 by John Edward Ravensbergen, Lyle Erwin Laun, and John G. Misselbrook, the disclosure of which is hereby incorporated by reference in its entirety

BACKGROUND

1. Field of the Disclosure

The present disclosure relates generally to a system of couplings or connectors and method of use of the couplings with a downhole tool for use in oil and gas wells, and more specifically, to a ported completion in combination with a system of couplings and a bottom hole assembly that can be employed for fracturing in multi-zone wells.

2. Description of the Related Art

Oil and gas well completions are commonly performed after drilling hydrocarbon producing wellholes. Part of the completion process includes running a well casing assembly into the well. The casing assembly can include multiple lengths of tubular casing attached together by collars. A standard collar can be, for example, a relatively short tubular or ring structure with female threads at either end for attaching to male threaded ends of the lengths of casing. The well casing assembly can be set in the wellhole by various techniques. One such technique includes filling the annular space between the wellhole and the outer diameter of the casing with cement.

After the casing is set in the well hole, perforating and fracturing operations can be carried out. Generally, perforating involves forming openings through the well casing and into the formation by commonly known devices such as a perforating gun or a sand jet perforator. Thereafter, the perforated zone may be hydraulically isolated and fracturing operations are performed to increase the size of the initially-formed openings in the formation. Proppant materials are introduced into the enlarged openings in an effort to prevent the openings from closing.

More recently, techniques have been developed whereby perforating and fracturing operations are performed with a coiled tubing string. One such technique is known as the Annular Coil Tubing Fracturing Process, or the ACT-Frac Process for short, disclosed in U.S. Pat. Nos. 6,474,419, 6,394,184, 6,957,701, and 6,520,255, each of which is hereby incorporated by reference in its entirety. To practice the techniques described in the aforementioned patents, the work string, which includes a bottom hole assembly ("BHA"), generally remains in the well bore during the fracturing operation(s).

One method of perforating, known as the sand jet perforating procedure, involves using a sand slurry to blast holes through the casing, the cement and into the well formation. Then fracturing can occur through the holes. One of the issues with sand jet perforating is that sand from the perforating process can be left in the well bore annulus and can potentially interfere with the fracturing process. Therefore, in some cases it may be desirable to clean the sand out of the well bore, which can be a lengthy process taking one or more hours per production zone in the well. Another issue with sand jet perforating is that more fluid is consumed to cut the perforations and either circulate the excess solid from the well or pump the sand jet perforating fluid and sand into the zone ahead of and during the fracture treatment. Demand in industry is going toward more and more zones in multi-zone wells, and some horizontal type wells may have 40 zones or more. Cleaning the sand from such a large number of zones can add significant processing time, require the excessive use of fluids, and increase the cost. The excessive use of fluids may also create environmental concerns. For example, the process requires more trucking, tankage, and heating and additionally, these same requirements are necessary when the fluid is recovered from the well.

Well completion techniques that do not involve perforating are known in the art. One such technique is known as ball drop open hole style completion. Instead of cementing the completion in, this technique involves running open hole packers into the well hole to set the casing assembly. The casing assembly includes ported collars with sleeves. After the casing is set in the well, the ports can be opened by operating the sliding sleeves. Fracturing can then be performed through the ports.

For multi-zone wells, multiple ported collars in combination with sliding sleeve assemblies have been employed. The sliding sleeves are installed on the inner diameter of the casing and/or sleeves and can be held in place by shear pins. In some designs, the bottom most sleeve is capable of being opened hydraulically by applying a differential pressure to the sleeve assembly. After the casing with ported collars is installed, a fracturing process is performed on the bottom most zone of the well. This process may include hydraulically sliding sleeves in the first zone to open ports and then pumping the fracturing fluid into the formation through the open ports of the first zone. After fracturing the first zone, a ball is dropped down the well. The ball hits the next sleeve up from the first fractured zone in the well and thereby opens ports for fracturing the second zone. After fracturing the second zone, a second ball, which is slightly larger than the first ball, is dropped to open the ports for fracturing the third zone. This process is repeated using incrementally larger balls to open the ports in each consecutively higher zone in the well until all the zones have been fractured. However, because the well diameter is limited in size and the ball sizes are typically increased in quarter inch increments, this process is limited to fracturing only about 11 or 12 zones in a well before ball sizes run out. In addition, the use of the sliding sleeve assemblies and the packers to set the well casing in this method can be costly. Further, the sliding sleeve assemblies and balls can significantly reduce the inner diameter of the casing, which is often undesirable. After the fracture stimulation treatment is complete, it is often necessary to mill out the balls and ball seats from the casing.

Another method that has been employed in open-hole wells (that use packers to fix the casing in the well) is similar to the ball drop open hole style completion described above, except that instead of dropping balls to open ports, the sleeves of the subassemblies are configured to be opened mechanically. For example, a shifting tool can be employed to open and close the sleeves for fracturing and/or other desired purposes. As in the case of the completion, the sliding sleeve assemblies and the packers to set the well casing in this method can be costly. Further, the sliding sleeve assemblies can undesirably reduce the inner diameter of the casing. In addition, the sleeves are prone to failure due to high velocity sand slurry erosion and/or sand interfering with the mechanisms.

Another technique for fracturing wells without perforating is disclosed in co-pending U.S. patent application Ser. No.

12/826,372 entitled "JOINT OR COUPLING DEVICE INCORPORATING A MECHANICALLY-INDUCED WEAK POINT AND METHOD OF USE," filed Jun. 29, 2010, by Lyle E. Laun, which is incorporated by reference herein in its entirety.

Other techniques for fracturing wells without perforating are disclosed in co-pending U.S. patent application Ser. No. 12/842,099 entitled "BOTTOM HOLE ASSEMBLY WITH PORTED COMPLETION AND METHODS OF FRACTURING THEREWITH," filed Jul. 23, 2010 by John Edward Ravensbergen and Lyle Laun, and Ser. No. 12/971,932 entitled "MULTI-ZONE FRACTURING COMPLETION," filed Dec. 17, 2010 by John Edward Ravensbergen, both which are incorporated by referenced herein in its entirety.

One potential problem with using coiled tubing in a horizontal well is accurately positioning a BHA at a desired location within the well so that the BHA is adjacent to a fracture port permitting communication to the zone to be fractured and/or treated. While moving a BHA up the casing, coiled tubing operators often rely on a tally sheet that indicates the length of casing segments or tubulars that have been inserted into the well. Coiled tubing operators generally run a BHA on coiled tubing to the bottom of the well and then pull the coiled tubing up the casing using the tally sheet to indicate casing joints, couplings, or connections along the casing tubular string. As the BHA is pulled up the string a casing collar locator ("CCL") is used to help determine the location of the BHA. As is known by one of ordinary skill in the art, a mechanical CCL engages a locating profile on joints or connections between casing or tubular segments, which requires the operator to increase the pull out of hole force as the CCL passes through each connection as the BHA is moved up the well.

The operator uses the tally sheet in combination with pulling the CCL through each connector to determine the actual location of the BHA. However during the installation of the casing or tubing, the depths recorded on the tally sheet may not be accurate. For example, upon creating the tally sheet an incorrect length for a tubular or casing segment may be recorded leading to an inaccurate determination of the current position of the BHA. The operator may encounter a joint earlier than expected causing the operator to stop the process to determine the actual location of the BHA. Each such determination can add additional hours to the overall time required for the multi-zone treatment and/or stimulation process. A well may typically have 15-20 zones to be treated and/or stimulated. The problem of having an incorrect tally sheet for locating one zone can be problematic when locating the following zones during the process. Having problems locating multiple zones during the treatment and/or stimulation process can add a large number of hours and thus, expense to the operation. Thus, it would be beneficial to improve the confidence in properly locating the BHA with a failure rate that is at least 1 out of 50 or even better than 1 out of 100 to potential minimize the overall cost of the operation.

Additionally, the coiled tubing operator may sense false indications at the surface creating additional confusion as to the actual location of the BHA. A false indication is caused by an increase in the pull out of hole (POOH) force without the CCL engaging a collar profile. False indications may be caused by several factors. The POOH force is a function of the contact forces along the length of the coiled tubing and the coefficient of friction. In a horizontal well only a portion of the coiled tubing is in contact with the well casing, due to the helical or curved shapes of the coiled tubing and the well bore. Therefore the false indication created by the variations in POOH may be caused by these geometrical differences, and/or the difference between static and dynamic coefficients of friction. The POOH force is typically greater than the force required to pull the CCL through a collar profile and therefore the variations are large enough to create false indications. In addition, sand within the horizontal well introduces yet another variable that may interfere with movement of the BHA and potentially leading to false indications at the surface.

One potential way to limit false positives would be to increase the POOH force require to pull the CCL through a collar profile by increasing the force of the spring loaded dogs on the CCL. However, as the force of the spring loaded dogs are increase the required pushing force to run into the hole (RIH) also increases. Presently, it can be difficult to push the BHA with the CCL to the bottom of a horizontal well with coiled tubing due to the limited pushing capacity of the coiled tubing. A larger diameter of coiled tubing could possibly be used to increase the pushing capacity, but the use of a larger diameter of coiled tubing would also present a greater expense.

The stimulation and/or treating of multiple zones within a well is a time consuming and costly operation. The time required to stimulate the specified multiple zones potentially increases if the operator repeatedly needs to take additional time to determine the actual location of a BHA rather than being able to move directly to each zone and perform the stimulation and/or treatment. Thus, it would be beneficial to provide a system and/or method that increases the efficiency of moving and locating a BHA within each zone to be stimulated and/or treated.

The present disclosure is directed to overcoming, or at least reducing the effects of, one or more of the issues set forth above.

SUMMARY OF THE DISCLOSURE

The following presents a summary of the disclosure in order to provide an understanding of some aspects disclosed herein. This summary is not an exhaustive overview, and it is not intended to identify key or critical elements of the disclosure or to delineate the scope of the invention as set forth in the appended claims.

One embodiment of the present disclosure is a wellbore completion for a horizontal well comprising a housing having at least one port through the housing that permits fluid communication from the interior to the exterior. The port is adapted to be selectively opened to permit fluid communication through the port and closed to prevent fluid communication through the port. The system includes a first coupling connected to a first end of first pup joint. The first coupling includes a recess configured to engage a locating dog of a CCL that is connected to coiled tubing. The system includes a second coupling connected to a second end of the first pup joint and also connected to a first end of the ported housing. The second coupling including a recess configured to engage a locating dog of the CCL. The system includes a third coupling connected to a second end of the housing. The third coupling including a recess configured to engage a locating dog of the CCL.

The system may include a second pup joint and a fourth coupling. The third coupling being connected to a first end of the second pup joint and the fourth coupling being connected to a second end of the second pup joint. The fourth coupling including a recess that is adapted to engage the locating dog of the CLL. The first pup joint, second pup joint, and the housing may each have a length that is 8 meters or less. The first and second pup joints may have a length of approximately 1.8 meters and the housing may have length of approximately 2.65 meters. The couplings may each include premium threaded connections. The lengths of the pup joints and the ported housing may be adapted to position a bottom hole assembly adjacent to the port of the portioned housing when the CCL engages the first coupling, the second coupling, the third coupling, or the fourth coupling.

One embodiment of the present disclosure is a wellbore completion system for a horizontal well having a housing having at least one port through the housing that selectively permits fluid communication through the port to an exterior of the housing. The system includes a first coupling connected by premium threads to a first end of the housing. The first coupling including a recess configured to engage a portion of a CCL connected to coiled tubing. The system includes a second coupling connected by premium threads to a second end of the housing. The second coupling having a recess configured to engage the portion of the CCL.

One embodiment of the present disclosure is a method for treating multiple zones within a horizontal well including moving a tool up a casing string to a first zone and engaging a first coupling with a portion of the tool. The method includes pulling the tool into the first coupling, which provides a first indication at the surface. The method includes engaging a second coupling with the portion of the tool and pulling the tool into the second coupling, which provides a second indication at the surface. The distance between the first and second couplings may be 8 meters or less. The method includes engaging a third coupling and pulling the tool into the third coupling, which provides a third indication at the surface. The method includes treating the first zone.

The method may further include positioning the tool to permit the treatment of the first zone prior to treating the first zone. Positioning the tool may include moving to and engaging the first coupling, second coupling, or third coupling. Moving to and engaging one of the couplings may position a packer element of the tool adjacent to a ported housing that permits selective communication to the first zone. Position the tool may alternatively include moving the tool to position the packer element adjacent to the ported housing without engaging one of the couplings.

The method may further include engaging a fourth coupling with a portion of the tool prior to treating the zone and pulling the tool into the fourth coupling, which provides a fourth indication at the surface. Positioning the tool may include moving the tool below the first coupling, moving the tool up to engage the first coupling, pulling the tool through the first coupling, and moving the tool up to engage the second coupling. The indications at the surface provided by pulling into the couplings may be force indications.

The method may include moving the tool to a second zone after treating the first zone. The method may be repeated to engage and pull into the couplings for the second zone providing indications at the surface. The second zone may then be treated. Prior to treating the second zone, the tool may be moved to and engage one of the couplings to properly position the tool to permit the treatment of the second zone.

Figure 1:
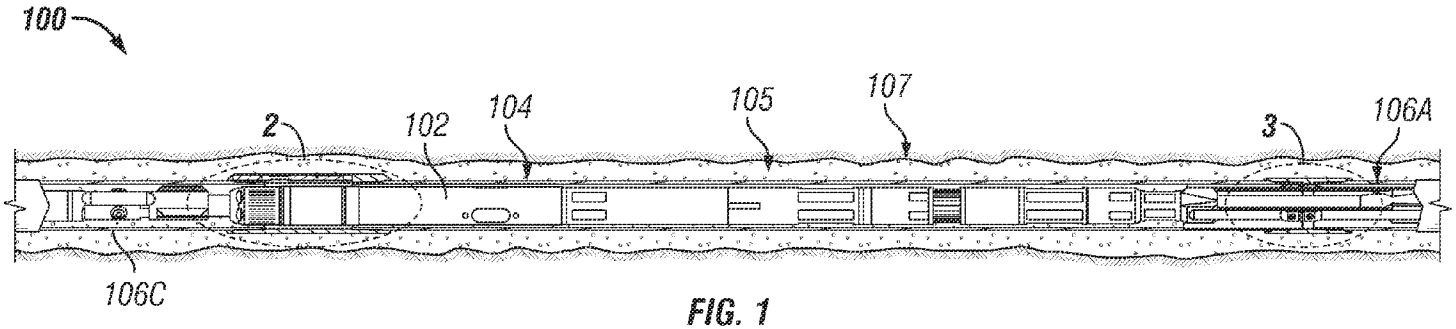
FIG. 1 illustrates a portion of a cemented wellbore completion.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

Figure 6:
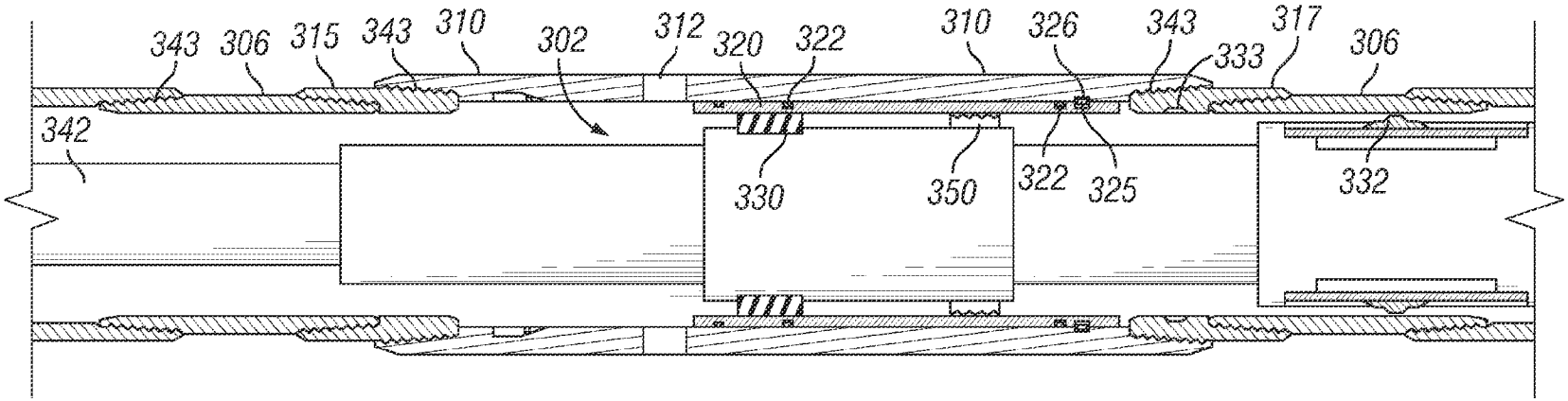
FIG. 6 illustrates a cross-section view of a bottom hole assembly anchored to a portion of the ported wellbore completion of 5.
Figure 7:
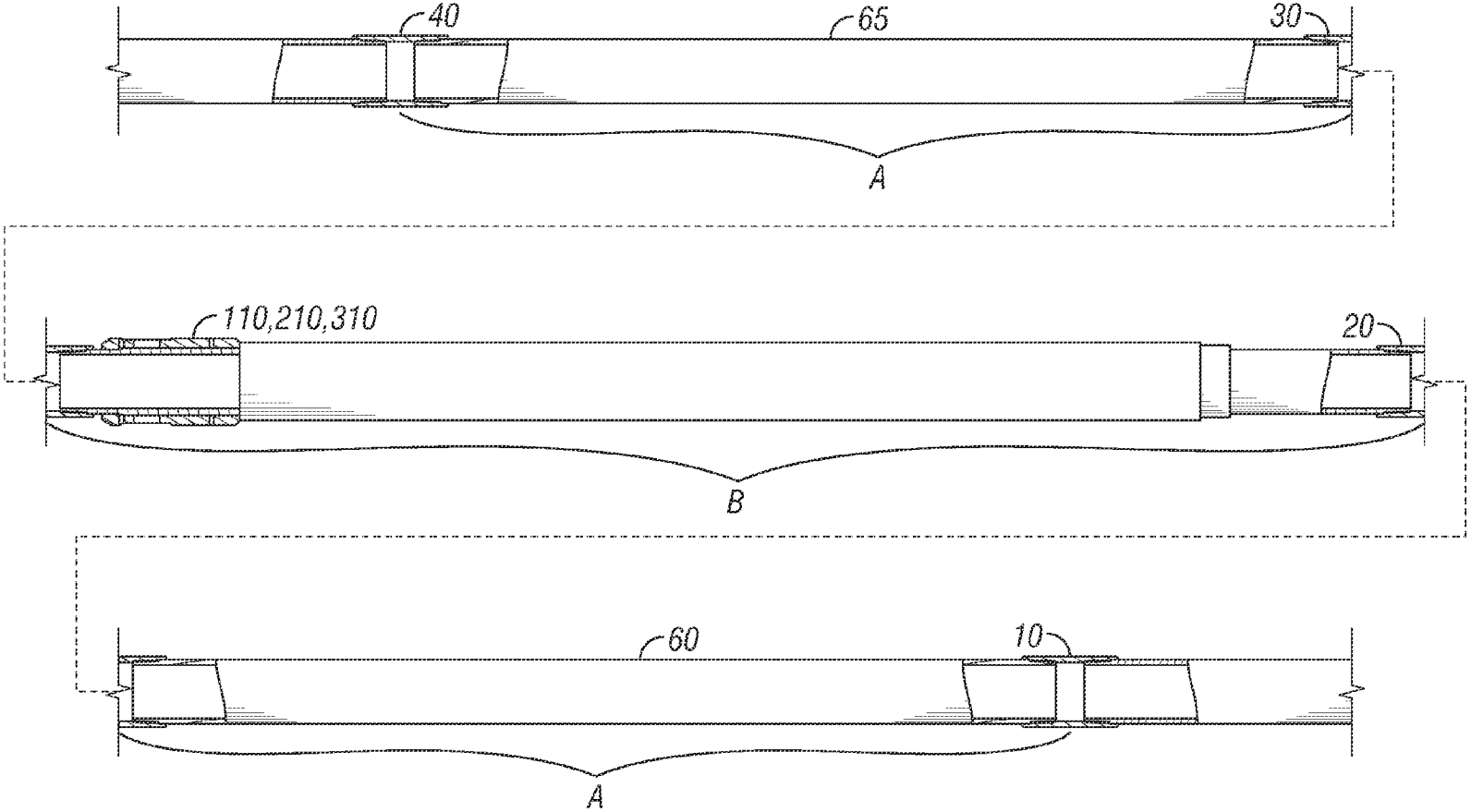
FIG. 7 illustrates an embodiment of a configuration of couplings that may be used to position a BHA within a ported collar or housing.

FIG. 7 shows an embodiment of a configuration of connectors or couplings 10, 20, 30, and 40 (hereinafter referred to as couplings) that permits an increased efficiency in locating a BHA 102 (shown in FIG. 8) within a ported housing 110, 210, or 310. Examples of various embodiments of ported housings or ported collars 110, 210, or 310 are shown in FIG. 1-6, as discussed below. The configurations of the ported housings are for illustrative purposes as the system and method concerning couplings 10, 20, 30, and 40 may be used to locate a downhole tool, such as a BHA, within various housings and ported segments as would be appreciated by one of ordinary skill in the art having the benefit of this disclosure.

The couplings 10, 20, 30, and 40 are used to connect together casing segments of a specific length, A, and a ported housing also having a specific length, B. The couplings are adapted to accurately indicate the location of a BHA 102 at the surface as well as properly position the BHA 102 adjacent to the ported housing 110 to stimulate and/or treat a well formation adjacent to the ported housing 110, as discussed below. Each of the couplings 10, 20, 30, and 40 includes a recess adapted to engage a mechanical CCL 50. The CCL 50 includes an expandable member 55 that engages a recess within the coupling 10, 20, 30, and 40.

The first or lowest coupling 10 is connected to the lower end of a casing segment 60 and the second or next lowest coupling 20 is connected to the upper end of the casing segment 60. The length of the casing segment is A, which preferably may be 1.8 meters. The third or next lowest coupling 30 is connected to the lower end of a second casing segment 65 that has an identical length A, as the first casing segment 60. The fourth or highest coupling 40 is connected to the upper end of the second casing segment 65. The second coupling 20 is also connected to the lower end of a ported housing 110 and the third coupling 30 is also connected to the upper end of the ported housing 110. The ported housing has a length B, which preferably may be 2.65 meters. The ported housing section may comprise a ported housing and casing segment connected together to comprise an overall length B.

Figure 2:
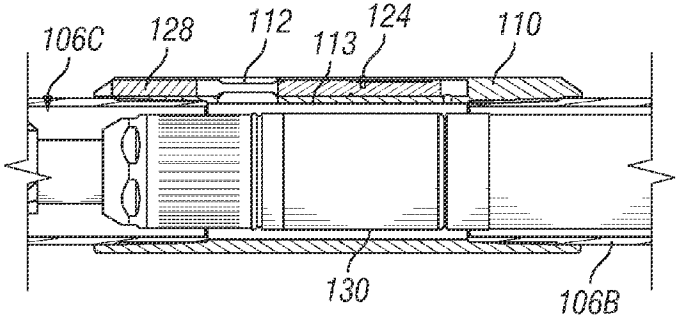
FIG. 2 illustrates a close up view of an embodiment of a collar and bottom hole assembly that may be used with the present disclosure.

FIG. 1 illustrates a portion of a wellbore completion 100 that includes a BHA 102 attached to coiled tubing and positioned inside of a ported collar assembly. FIG. 2 shows a close-up cross-section view of the BHA 102 within the ported collar 110 of the ported collar assembly. Preferably, the BHA 102 is designed for carrying out fracturing in a multi-zone well. An example of a suitable BHA is disclosed in copending U.S. patent application Ser. No. 12/626,006, filed Nov. 25, 2009, in the name of John Edward Ravensbergen and entitled, COILED TUBING BOTTOM HOLE ASSEMBLY WITH PACKER AND ANCHOR ASSEMBLY, the disclosure of which is hereby incorporated by reference in its entirety.

Figure 3:
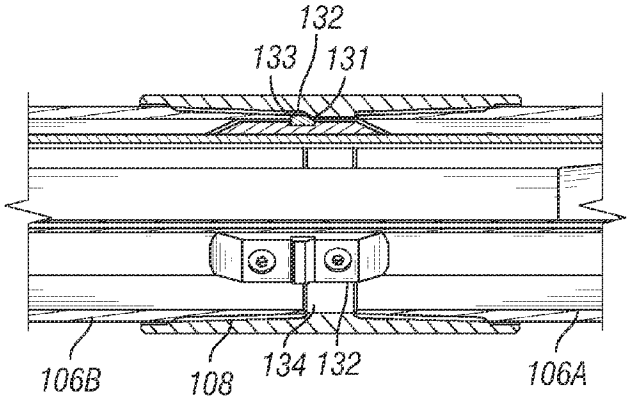
FIG. 3 illustrates a close up view of a locating dog used in the wellbore completion of FIG. 1.

As more clearly illustrated in FIGS. 2 and 3, the ported collar assembly can include multiple casing lengths 106A, 106B and 106C that can be connected by one or more collars, such as collars 108 and 110. The collars may be ported, as shown by collar 110. Collar 108 can be any suitable collar. Examples of collars for connecting casing lengths are well known in the art. In an embodiment, collar 108 can include two female threaded portions for connecting to threaded male ends of the casing lengths 106.

A plurality of housings or collars 110 that include one or more fracture ports 112 may be positioned along the casing 104. The inner diameter 113 of the ported collar 110 can be approximately the same or greater than the inner diameter of the casing 104. In this way, the annulus between the collar 110 and the BHA 102 is not significantly restricted. In other embodiments, the inner diameter of the collar 110 can be less than the inner diameter of the casing 104. Collar 110 can attach to casing lengths 106 by any suitable mechanism. In an embodiment, collar 110 can include two female threaded portions for connecting to threaded male ends of the casing lengths 106B and 106C.

A valve may be positioned within the collar 110 that may be actuated to selectively open or close the fracture ports through the collar 110. A shear pin 124 can be used to hold the valve in the closed position during installation and reduce the likelihood of valve opening prematurely.

As also shown in FIG. 2, a packer 130 on the BHA 102 can be positioned in the casing adjacent to the ported collar 110. When the packer 130 is energized, it seals on the inner diameter of the collar 110 to prevent or reduce fluid flow further down the well bore annulus. A pressure differential formed across the packer may be used to open the fracture or treatment ports 112 of the collar 110.

It is necessary to properly position the BHA 102 and specifically, the packer 130 at the desired position within a specific collar 110 along the casing 104. The BHA 102 may include a CCL that engages a groove in the connectors along the casing string 104. FIG. 3 shows a dog 132, such as used in connection with a mechanical CCL, which can be configured so as to drive into a recess 134 between casing portions 106A and 106B. As shown in FIG. 3, the dog 132 can be included as part of the BHA 102. The length of the casing portion 106B can then be chosen to position the collar 110 a desired distance from the recess 134 so that the packer 130 can be properly positioned within the ported collar 110. During installation, the well operator can install the BHA 102 by lowering the dog past the recess 134 and then raising the BHA 102 up until the dog 132 drives into the recess 134. An additional POOH force in pulling dog 132 out of the recess 134 will be detectable at the surface and can allow the well operator to determine when the BHA 102 is correctly positioned in the casing. During the running in process, the dogs 132 (shown in FIG. 3) may be profiled such that they do not completely engage and/or easily slide past the recesses 134. For example, the dogs 132 can be configured with a shallow angle 131 on the down hole side to allow them to more easily slide past the recess 134 with a small axial force when running into the well. However as discussed above, the use of coiled tubing in a horizontal well and an inaccurate tally sheet may present difficulties in properly locating the BHA 102 within a specific collar 110. To reduce the possibility of inaccurately positioning the BHA 102 with a specified collar 110, the system of casing segments 60, 65 and couplings 10, 20, 30, and 40 of FIG. 7 may be used in connection with the collar 110 in place of the casing segments 106 connected to the collar 110.

The casing 104, which may include a plurality of sections that include a ported housing, system of couplings, and corresponding casing segments, can be installed after well drilling as part of the completion 100. FIG. 1 illustrates the cement 105, which is flowed into the space between the outer diameter of the casing 104 and the inner diameter of the wellhole 107. Techniques for cementing in casing are well known in the art.

As discussed above, ported collars 110 and/or ported housings can be positioned in the casing wherever ports are desired for fracturing. In an embodiment, the collars 110 of the present disclosure and the coupling system can be positioned in each zone of a multi-zone well.

Figure 4:
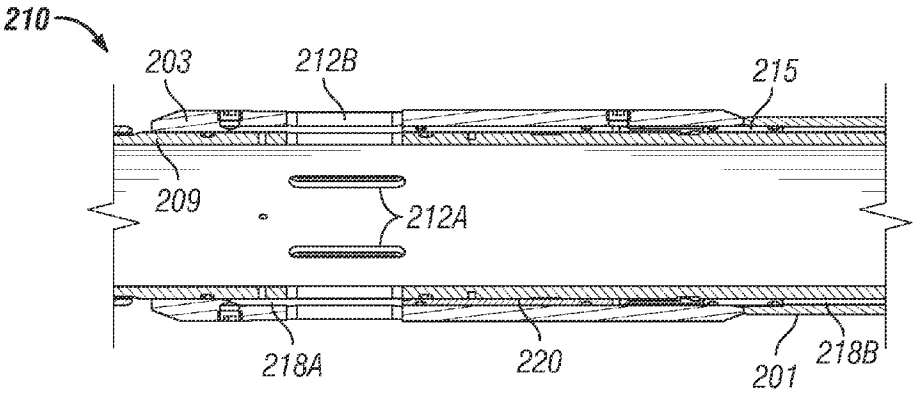
FIG. 4 illustrates a portion of an embodiment of a ported collar that may be used with the present disclosure.

FIG. 4 shows a portion of another embodiment of a ported collar 210 that may be used in connection with the coupling system of the present disclosure. The collar 210 comprises a mandrel 209, which may comprise a length of casing length, a valve housing 203, and a vent housing 201. A valve, such as a sleeve 220, is positioned within an annulus 218A between the mandrel 209 and the valve housing 203. The sleeve 220 is movable between an open position that permits communication between the inner diameter of the mandrel 209 and outer fracture ports 212B through inner fracture port 212A located in the mandrel 209. The annulus 218A extends around the perimeter of the mandrel and is in communication with the annulus 218B between the vent housing 201 and the mandrel 209. The sleeve 220 may be moved into a closed position preventing fluid communication between the inner fracture port 212A and outer fracture port 212B. The sleeve 220 effectively seals the annulus 218 into an upper portion 218A and 218B thus, permitting a pressure differential between the two annuluses to move the sleeve 220 between its open and closed positions. A seal ring 215 may be used connect the valve housing 203 to a vent housing 201.

Figure 5:
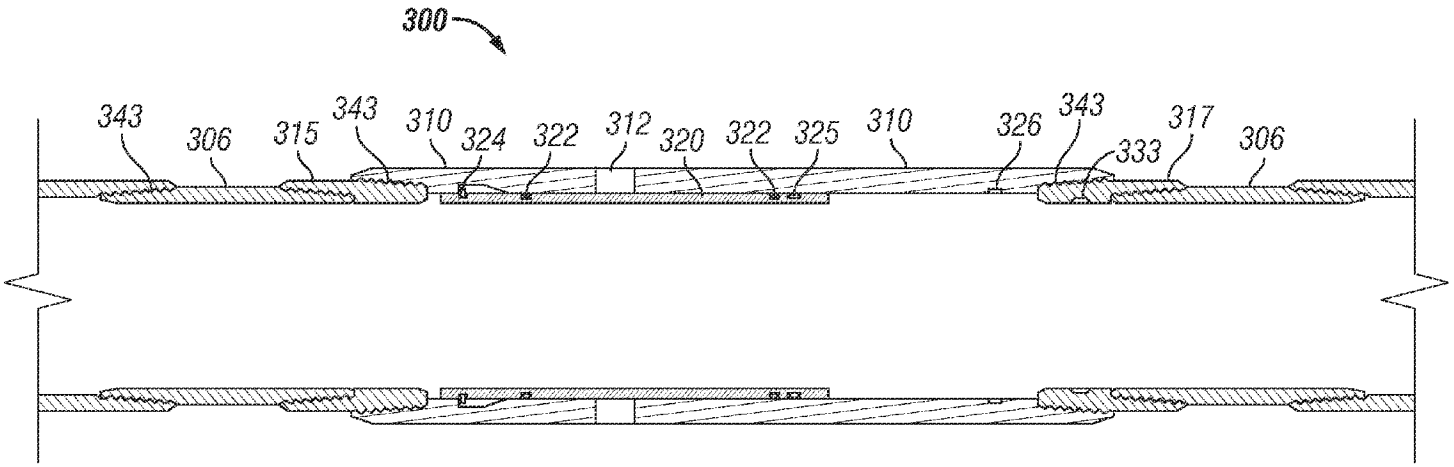
FIG. 5 illustrates a cross-section view of an embodiment of ported wellbore completion that may be used with the present disclosure.

FIG. 5 shows another embodiment of a ported housing 310 that may be used in connected with this disclosure. The coupling system and corresponding segments may replace the pup joints and cross-overs as described in connection with FIG. 5. A pup joint 306 may be connected to one end of a ported housing 310 by an upper cross-over 315. Pup joints are well known in the art as being segments used to adjust lengths between couplings or connectors that are shorter than conventional casing segments. A pup joint typically is 1 to 3 meters in length but may vary in length between 1 and 8 meters in length. The other end of the ported housing 310 is connected to another pup joint 306 by a lower cross-over 317. The pup joints 306 may be connected to conventional casing tubulars to comprise a section of a casing string. The segments of the casing string are secured together via threads 343. The connection via threads and configuration of the casing segments are shown for illustrative purposes as different connection means and any suitable configurations may be used within the spirit of the disclosure. For example, the ported housing 310 could be connected directly to pup joints 306 without the use of cross-over connectors 315, 317.

The ported housing 310 includes at least one fracture port 312 that permits fluid communication between the interior and exterior of the housing 310. A sleeve 320 may be slidably connected to the interior surface of the housing 310. In an initial position, as shown in FIG. 5, the sleeve 320 may be positioned such that seals 322 prevent fluid communication through port 312. A shearable device 324 may be used to selectively retain the sleeve 320 in an initial closed position. The shearable device 324 may be a shear pin, crush ring, or other device adapted to selectively release the sleeve 320 from the housing 310 upon the application of a predetermined force, which may be applied by hydraulic pressure as discussed in detail below.

FIG. 6 shows a BHA 302 connected to coiled tubing 342 that has been inserted into the casing and used to open the sleeve 320 on the ported housing 310. A casing collar locator may be used to position the BHA 302 at desired proper location within the casing. For example, a lower cross-over 317 may include a profile 333 that is adapted to engage a profile 332 of the casing collar locator to properly position the BHA 302 within a specific ported housing 310 along the casing string.

The BHA 302 includes a packer 330 that may be activated to seal the annulus between the exterior of the BHA 302 and the interior diameter of the sleeve 320 of the ported housing 310. The BHA 302 also includes an anchor 350 that may be set against the sleeve 320. Application of pressure down the coiled tubing is used to activate the anchor 350 and set it against the sleeve 320 as well as to set the packer 330.

After setting the anchor 350 to secure the BHA 302 to the sleeve 320 and activating the packer 330, fluid may be pumped down the casing creating a pressure differential across the packer 330. Upon reaching a predetermined pressure differential, the shearable device 324 will shear and thereby release the sleeve 320 from the housing 310. The shearable device 324 may be adapted to shear at a predetermined pressure differential as will be appreciated by one of ordinary skill in the art.

After the shearable device releases the sleeve 320 from the housing 310, the pressure differential across the packer 330 will then move the BHA 302, which is anchored to the sleeve 320, down the casing. In this manner, the sleeve 320 can be moved from a closed position to an open position as shown in FIG. 6.

Upon moving to the open position, the sleeve 320 may be selectively locked into the open position. For example, the sleeve 320 may include an expandable device 325, such as a "c" ring or a lock dog, which expands into a groove 326 in the interior of the housing 310 selectively locking the sleeve 320 in the open position. In the open position, fluid may be communicated between the interior of the housing 310 to the exterior of the housing 310, permitting the treatment and/or stimulation of the well formation adjacent to the port 312.

As discussed above, the use of coiled tubing in a horizontal well may increase the difficulty in properly positioning a BHA 102 within a ported housing that is adapted to permit the selective treatment and/or stimulation of the well formation adjacent the ported housing. The ported housing or ported collar may be one of the embodiments shown above 110, 210, 310 or a different configuration that is adapted to provide selective treatment and/or stimulation of the well formation.

As discussed above, FIG. 7 shows an embodiment of a configuration of couplings 10, 20, 30, and 40 that permits an increased efficiency in locating a tool, such as a BHA 102, within a specified portion of a casing string, which may include a ported housing 110. Each of the couplings 10, 20, 30, and 40 includes a recess adapted to engage a mechanical CCL 50. The CCL 50 includes an expandable member 55 that engages a recess within the coupling 10, 20, 30, and 40.

The use of the four couplings 10, 20, 30, and 40 at known spacings increases the likelihood that the operator will be able to determine that the BHA 102 is correcting located within a specific ported housing. The predetermined lengths between the couplings are used to identify and ignore false indications at the surface and provide better confidence in the determination of the actual location of the BHA 102. Specifically, the system may be configured so that a length A is used between the first or lowest coupling 10 and the adjacent coupling 20. The same length A may be used between the highest coupling 40 and its adjacent coupling 30. The second coupling 20 and third coupling 30 may be configured so that the two couplings are a second length or distance B apart. The second distance B may differ from the first distance A. However, alternatively the distances A and B may be equal being at least 1 meter shorter than the length of conventional casing segments. Preferably, both the first distance A and the second distance B differ from typical lengths of casing or tubular strings. For example, conventional casing segments are approximately 12 meters long. In a preferred embodiment, the first distance A may be approximately 1.8 meters and the second distance B may be approximately 2.65 meters. The distances of 1.8 meters and 2.65 meters is for illustrative purposes only as one of ordinary skill in the art will appreciate different lengths may be used to properly indicate at the surface the presence of a BHA 102 within a ported housing. More importantly is the use of four couplings having three lengths that differ from conventional casing lengths. Also the use of two identical lengths and one differing length increases the confidence at the surface that the BHA 102 is properly positioned within a ported housing. However, the use of a first length A between the two lower couplings and two upper couplings and the use of a second length B between the middle couplings as shown in FIG. 7 is for illustrative purposes only. The use of three predetermined lengths in various configurations may be used to identify and ignore false indications at the surface and provide better confidence in the determination of the actual location of a downhole tool as would be appreciated by one of ordinary skill in the art having the benefit of this disclosure. For example, the couplings may be spaced apart by three different predetermined lengths or the two lower lengths may both be a substantially equal predetermined length with the highest length being a different predetermined length.

The use of a configuration of couplings 10, 20, 30, and 40 of the present disclosure will indicate at the surface when the operator has pulled a BHA 102 through portion of the casing 104 having a ported housing. As a BHA is pulled through the system of four couplings there should be four indications at the surface, with the last three being at distances much shorter than typical casing segments. The indications will be at the surface as the CCL of the BHA is pulled into each of the couplings. The second and fourth indicator should occur after pulling the coiled tubing, and thus the BHA 102, up an identical distance A, which preferably may be approximately 1.8 meters. The third indicator should occur after pulling the coiled tubing, and thus the BHA 102, up a second distance B, which preferably may be approximately 2.65 meters. The distances A, B are both much shorter than the typical length of a casing segment.

Figure 8:
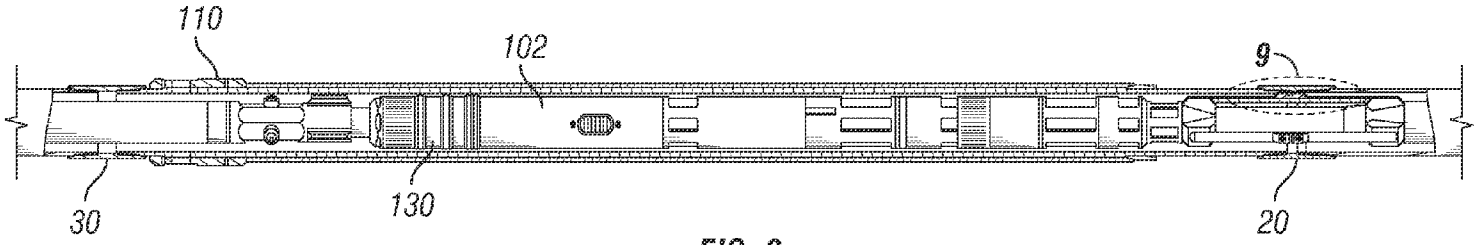
FIG. 8 illustrates a cross-section view of a BHA positioned within a ported housing.

After the fourth indicator, the operator may move the BHA 102 back down past the lowest coupling 10 of the system. Then coiled tubing will then be moved up pulling the BHA 102 through the first coupling 10 until the CLL engages or "parks" in the second coupling 20. Engagement of the CCL with the second coupling 20 properly positions the BHA 102 within the ported housing. The method of moving the BHA 102 down past the lowest coupling then moving it up to park in the second lowest coupling may be preferred if using a j-slot tool, which is known in the art. The position of the BHA may locate the packing element 130 so that it may be engaged and permit treatment and/or stimulation of the formation through a fracture port of the ported housing 110, as shown in FIG. 8. However, the configuration of the ported housing and the four couplings as shown in FIG. 7-8 and method of use is for illustrative purposes only as the configuration may be varied as would be appreciated by one of ordinary skill in the art having the benefit of this disclosure. For example, the operator may not move the BHA back down past the lowest coupling of the system. Instead the operator may move the BHA to engage or "park" the CCL in any one of the couplings to properly position the packing element adjacent to the ported housing. The system may be configured so that the first coupling, second coupling, third coupling, or fourth coupling may be used to properly position the packing element of the BHA. The use of the couplings is the most accurate means to locate the packing element of the BHA and therefore may permit the use of the shortest ported housing, which may decrease the overall cost of the assembly. Further, the operator may not have to engage a coupling to properly position the packing element, but rather move the BHA down to the appropriate position between two of the couplings to properly position the packing element.

Figure 11:
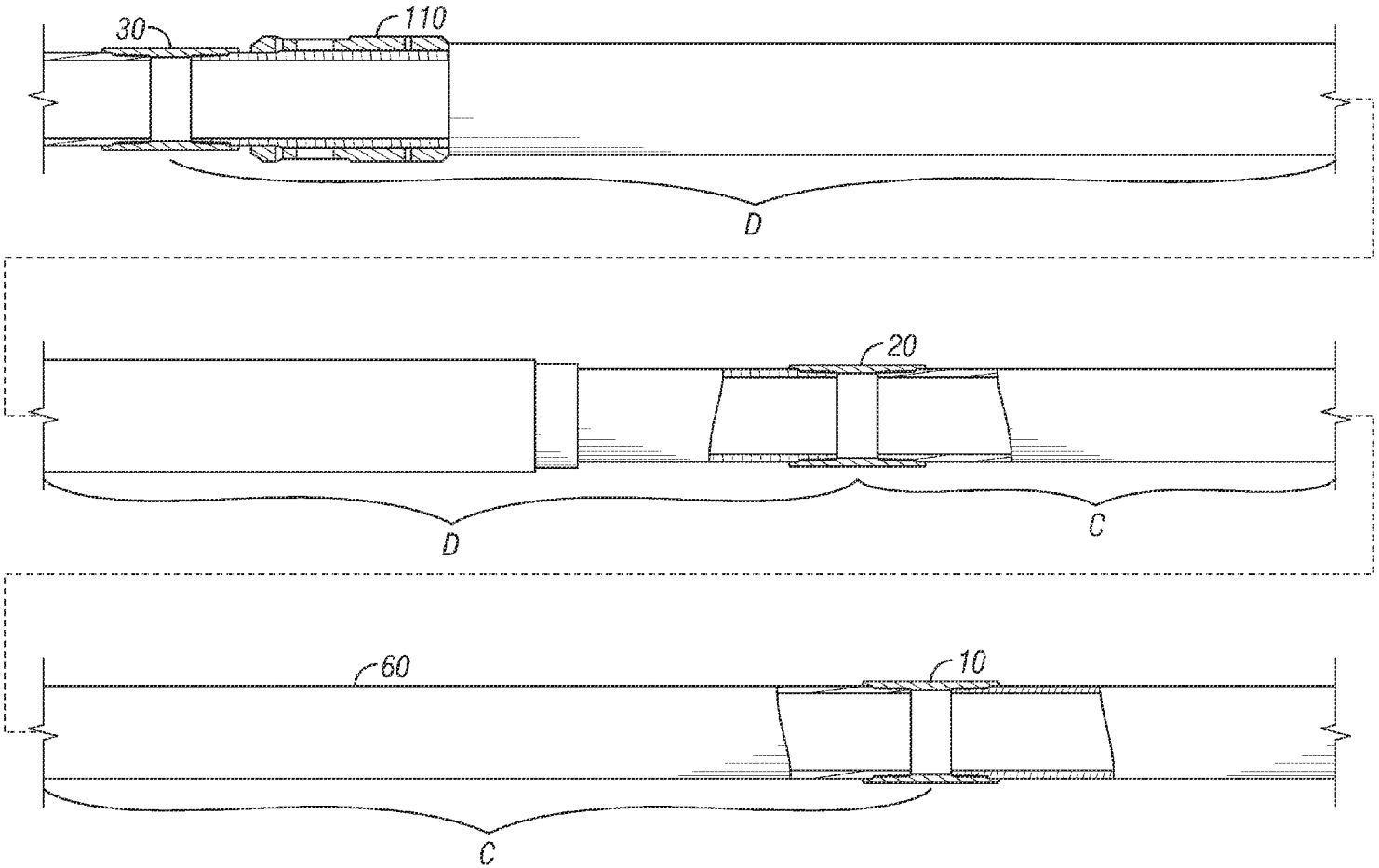
FIG. 11 illustrates an embodiment of a configuration of couplings that may be used to position a BHA within a ported collar or housing.

The number of couplings and configurations may be varied. For example, three couplings having two predetermined lengths between the couplings may be used in to locate a BHA within a ported housing. FIG. 11 shows an embodiment of a coupling system that uses three couplings to locate a BHA within a ported housing. A first coupling 10 is connected to one end of a tubular 60 with a second coupling 20 connected to the other end of the tubular 60. The second coupling 20 is also connected to one end of a ported housing 110 with a third coupling 30 being connected to the other end of the ported housing 110. The BHA may be pulled through the three couplings 10, 20, and 30 providing three indications at the surface. The indications at the surface may be provided as the CCL of the BHA is pulled into each coupling. The first coupling 10 and second coupling 20 may be separated by a distance C and the second coupling 20 and the third coupling 30 may be separated by a distance D. The distances C and D are both preferably smaller in length the length of traditional casing segments. For example, the distance C may be 1.8 meters and the distance D may be 2.65 meters. Alternatively, the distances C and D may be equal and may be less than 8 meters. The lengths C and D may not be equal, but both may be less than 4 meters providing an indication at the surface of the location of the BHA. The use of lengths that are substantially shorter than traditional casing segments, typically between 10-12 meters, provides indicators at the surface that the BHA has reached the zone of interest that includes the coupling system.

In another embodiment using four coupling, the ported housing 110 may be positioned between the upper coupling 40 and the third coupling 30 so that the third coupling 30 is used to properly locate the BHA within the ported housing. The use of four couplings provides four indicators at the surface, which may permit the operator to ignore a false positive with more confidence in comparison to prior art systems having a smaller number of indicators.

Figure 10:
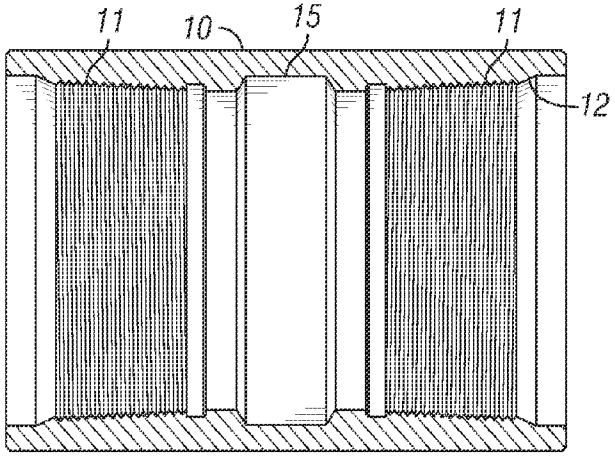
FIG. 10 illustrates a cross-section view of an embodiment of a coupling that includes a CLL gap and may be used to locate a BHA within a ported housing.
Figure 9:
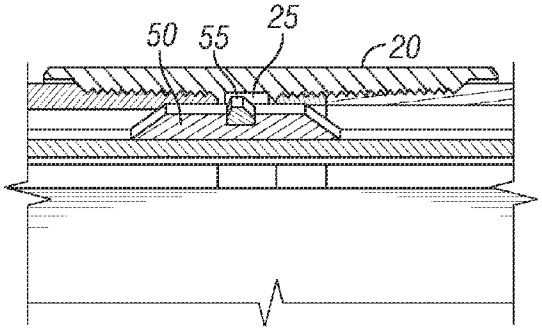
FIG. 9 illustrates a close-up cross-section view of a CLL used to position the BHA of FIG. 8.

FIG. 9 shows a cross-section close-up view of a protrusion 55 of the CCL 50 engaging a recess 25 within the second coupling 20. Each of the couplings 10, 20, 30, and 40 used in the system includes a recess that is adapted to engage a portion of a mechanical CLL providing an indication at the surface. FIG. 10 shows an embodiment of a coupling of the present disclosure. The coupling 10 includes premium threads 11, such as VAM threads, that are used to connect casing segments (not shown in FIG. 10). The coupling 10 contains a profile 15 to engage the CCL protrusion 55. The sealing areas for conventional threads are dependent on the thread profile. A conventional thread is typically an API 8 round threaded connection. Premium threads are defined herein as a threaded connection other than a convention API 8 round threaded connection. Conventional couplings that include premium threaded connections typically do not include a recess adapted to engage a protrusion (i.e. locking dog) of a mechanical CCL. Some examples of premium threads are VAM, Hydril PH6, and Altas Bradford. The premium threads 11 ensure that the connections between the casing segments and the coupling 10 maintain a seal. The coupling 10 may include a shoulder 12 that the casing segments abut against when completely threaded into the coupling 10. Conventional prior casing string couplings that include premium threads generally do not include a CLL gap or recess. The use of two "premium" connectors connected to each end of a ported housing in a horizontal well may provide sufficient indication at the surface that the BHA has been positioned within the ported housing. The "premium" connectors, as discussed above, each have premium threaded connections and a recess adapted to engage the locating dog of a mechanical CCL attached to coiled tubing.

The configuration of using four couplings spaced apart as discussed above reduces the likelihood that the operator will need to stop the treatment and/or stimulation process to determine the actual location of a BHA. For example, a segment on a tally sheet may be incorrectly recorded as being one meter longer than it actually is. As the operator moves a BHA through the section of casing that has been recorded incorrectly, the operator will receive an indicator before expected based on the tally sheet. This unexpected indicator may cause the operator to stop the process to investigate the actual location of the BHA causing an increase in the overall multi-zone stimulation process.

The disclosed system and method provides an operator with better confidence as to the location of the BHA as it enters into each zone to be stimulated and/or treated. For example, the operator can largely rely on receiving four indicators over a relatively short distance instead of a running count based on the tally sheet. Further, the use of two known distances, distance A and B, with the first distance being repeated provides an increased reliance at the surface that the BHA has reached a zone that is to be treated and/or stimulated. After pulling through the four couplings, the BHA can then be moved below the first coupling and pulled through the first coupling into the second coupling, which accurately positions the BHA to begin the treatment and/or stimulation process.

Although various embodiments have been shown and described, the disclosure is not so limited and will be understood to include all such modifications and variations as would be apparent to one skilled in the art.

What is claimed is:

1. A wellbore completion system for a multiple zone horizontal well, the system comprising:

a housing having at least one port through the housing that permits fluid communication from an interior of the housing to an exterior of the housing in a designated zone of the horizontal well, the port being adapted to be selectively opened to permit said fluid communication and closed to prevent said fluid communication;

a plurality of downhole casing segments each exhibiting a same length, each extending downhole of the designated zone toward a separated downhole zone of the horizontal well, and each being connected at both ends to couplings having a recess adapted to engage a locating dog of a casing collar locator CCL connected to coiled tubing;

a first coupling connected to a first end of a first pup joint, the first coupling having a recess adapted to engage the locating dog of the CCL connected to coiled tubing;

a second coupling connected to a second end of the first pup joint and connected to a first end of the ported housing, the second coupling having a recess adapted to engage the locating dog of the CCL connected to coiled tubing; and a third coupling connected to a second end of the ported housing, the third coupling having a recess adapted to engage the locating dog of the CCL connected to coiled tubing, wherein a length of the ported housing and a length of the first pup joint are both at least one meter less than the length of each of the plurality of downhole casing segments such that the first pup joint and the ported housing provide two consecutive lengths that, using the CCL, are distinct from the lengths of the plurality of downhole casing segments.

2. The system of claim 1 further comprising a second pup joint, the third coupling being connected to a first end of the second pup joint and a fourth coupling connected to a second end of the second pup joint, the fourth coupling having a recess adapted to engage the locating dog of the CCL connected to coiled tubing, wherein a length of the second pup joint is at least one meter less than the length of each of the plurality of downhole casing segments such that the first pup joint, the second pup joint, and the ported housing provide three consecutive lengths that, using the CCL, are distinct from the plurality of downhole casing segments.

3. The system of claim 2, wherein the first pup joint, the second pup joint, and the housing each have a length of 8 meters or less.

4. The system of claim 3, wherein the lengths of the first pup joint, the second pup joint, and the housing are adapted to position a bottom hole assembly adjacent to the at least one port when the portion of the CCL engages the first coupling.

5. The system of claim 3, wherein the lengths of the first pup joint, the second pup joint, and the housing are adapted to position a bottom hole assembly adjacent to the at least one port when the portion of the CCL engages the second coupling.

6. The system of claim 3, wherein the lengths of the first pup joint, the second pup joint, and the housing are adapted to position a bottom hole assembly adjacent to the at least one port when the portion of the CCL engages the third coupling.

7. The system of claim 3, wherein the lengths of the first pup joint, the second pup joint, and the housing are adapted to position a bottom hole assembly adjacent to the at least one port when the portion of the CCL engages the fourth coupling.

8. The system of claim 2 wherein the first pup joint and the second pup joint are each approximately 1.8 meters in length.

9. The system of claim 8 wherein the housing has a length of approximately 2.65 meters.

10. The system of claim 2, wherein the first coupling, the second coupling, the third coupling, and the fourth coupling each include premium threaded connections.

11. A wellbore completion system for a multiple zone horizontal well, the system comprising:

a housing having at least one port through the housing that permits fluid communication from an interior of the ported housing to an exterior of the ported housing in a designated zone of the horizontal well, the port being adapted to be selectively opened to permit said fluid communication and closed to prevent said fluid communication;

a plurality of downhole casing segments each exhibiting a same length, extending downhole of the designated zone toward a separated downhole zone of the horizontal well, and being connected at both ends by premium threads to couplings having a recess adapted to engage a portion of a casing collar locator (CCL) connected to coiled tubing;

a first coupling connected by premium threads to a first end of the ported housing, the first coupling including a recess adapted to engage the portion of the CCL connected to coiled tubing;

a second coupling connected by premium threads to a second end of the ported housing, the second coupling including a recess adapted to engage the portion of the CCL connected to coiled tubing;

a first tubular, the second coupling connected by premium threads to a first end of the first tubular; and a third coupling connected by premium threads to a second end of the first tubular, the third coupling including a recess adapted to engage the portion of the CCL connected to coiled tubing, wherein a length of the ported housing and a length of the first tubular are both at least one meter less than the length of each of the plurality of downhole casing segments such that the first tubular and the ported housing provide two consecutive lengths that, using the CCL, are distinct from the plurality of downhole casing segments.

12. The system of claim 11 wherein the first coupling is connected by premium threads to one of the plurality of downhole casing segments.

13. The system of claim 11 further comprising:

a second tubular, the third coupling connected by premium threads to a first end of the second tubular; and a fourth coupling connected by premium threads to a second end of the second tubular, the fourth coupling including a recess adapted to engage the portion of the CCL connected to coiled tubing.

14. The system of claim 13, wherein the first tubular and the second tubular are pup joints.

15. A method for treating multiple zones within a horizontal wellbore, the method comprising:

moving a tool up a casing string to a first zone in the horizontal wellbore, the casing string including a plurality of downhole casing segments each extending downhole of the first zone toward a separated downhole zone of the horizontal well, each being connected at both ends to downhole couplings, and each exhibiting a same distance between their respective downhole couplings;

engaging the downhole couplings with a portion of the tool;

pulling the tool into the downhole couplings, wherein pulling the tool into the downhole couplings provides indications at a surface revealing the distance between the downhole couplings;

engaging a first coupling of the first zone with the portion of the tool;

pulling the tool into the first coupling of the first zone, wherein pulling the tool into the first coupling of the first zone provides a first indication at the surface;

engaging a second coupling of the first zone with the portion of the tool, wherein a distance between the first coupling of the first zone and the second coupling of the first zone is 8 meters or less and is at least one meter less than the distance between the respective downhole couplings of each of the plurality of downhole casing segments;

pulling the tool into the second coupling of the first zone, wherein pulling the tool into the second coupling of the first zone provides a second indication at the surface revealing a distance between the first coupling and the second coupling;

engaging a third coupling of the first zone with the portion of the tool, wherein a distance between the second coupling of the first zone and the third coupling of the first zone is 8 meters or less and is at least one meter less than the distance between the respective downhole couplings of each of the plurality of downhole casing segments;

pulling the tool into the third coupling of the first zone, wherein pulling the tool into the third coupling of the first zone provides a third indication at the surface revealing a distance between the second coupling and the third coupling, such that the distance between the first and second coupling and the distance between the second and third coupling provide two consecutive distances that, using the tool, are distinct from the distance between the respective downhole couplings;

determining a position of the tool in the casing string with respect to the first, second, and third couplings using the two consecutive distances; and treating the first zone.

16. The method of claim 15, wherein coiled tubing is used to move the tool up the casing and pull the tool into the first coupling of the first zone, second coupling of the first zone, and third coupling of the first zone.

17. The method of claim 15, wherein the tool comprises a bottom hole assembly connected to coiled tubing, the bottom hole assembly include a packing element and a casing collar locator.

18. The method of claim 15 further comprising:

moving the tool up the casing string to a second zone in the horizontal wellbore;

engaging a first coupling of the second zone with the portion of the tool; pulling the tool into the first coupling of the second zone, wherein pulling the tool into the first coupling of the second zone provides an indication at the surface; engaging a second coupling of the second zone with the portion of the tool; pulling the tool into the second coupling of the second zone, wherein pulling the tool into the second coupling of the second zone provides an indication at the surface; engaging a third coupling of the second zone with the portion of the tool; pulling the tool into the third coupling of the second zone, wherein pulling the tool into the third coupling of the second zone provides an indication at the surface; and treating the second zone.

19. The method of claim 18 further comprising positioning the tool to permit the treatment of the second zone prior to treating the second zone.

20. The method of claim 18, wherein a distance between the first and second couplings of the second zone and a distance between the second and third couplings of the second zone are each 8 meters or less.

21. The method of claim 15 further comprising positioning the tool to permit the treatment of the first zone prior to treating the first zone.

22. The method of claim 21, wherein positioning the tool to permit treatment of the first zone further comprises moving the tool below the first coupling of the first zone, moving the tool up to engage the first coupling of the first zone, pulling the tool through the first coupling of the first zone, and moving the tool up to engage the second coupling of the first zone.

23. The method of claim 21, wherein positioning the tool to permit the treatment of the first zone further comprises moving the tool to the first coupling of the first zone and engaging the first coupling of the first zone to position a packer element of the tool adjacent to a ported housing that permits selective communication to the first zone.

24. The method of clam 21, wherein positioning the tool to permit the treatment of the first zone further comprises moving the tool to the second coupling of the first zone and engaging the second coupling of the first zone to position a packer element of the tool adjacent to a ported housing that permits selective communication to the first zone.

25. The method of claim 21, wherein positioning the tool to permit the treatment of the first zone further comprises moving the tool to the third coupling of the first zone and engaging the third coupling of the first zone to position a packer element of the tool adjacent to a ported housing that permits selective communication to the first zone.

26. The method of claim 21, wherein positioning the tool to permit the treatment of the first zone further comprises moving the tool to position a packer element of the tool adjacent to a ported housing that permits selective communication to the first zone.

27. The method of claim 21 further comprising:

engaging a fourth coupling of the first zone with the portion of the tool, wherein a distance between the third coupling of the first zone and the fourth coupling of the first zone is 8 meters or less; and pulling the tool into the fourth coupling of the first zone prior to positioning the tool to permit the treatment of the first zone, wherein pulling the tool into the fourth coupling of the first zone provides a fourth indication at the surface.

28. The method of claim 27, wherein positioning the tool to permit the treatment of the first zone further comprises moving the tool to the first coupling of the first zone and engaging the first coupling of the first zone to position a packer element of the tool adjacent to a ported housing that permits selective communication to the first zone.

29. The method of claim 27, wherein positioning the tool to permit the treatment of the first zone further comprises moving the tool to the second coupling of the first zone and engaging the second coupling of the first zone to position a packer element of the tool adjacent to a ported housing that permits selective communication to the first zone.

30. The method of claim 27, wherein positioning the tool to permit the treatment of the first zone further comprises moving the tool to the third coupling of the first zone and engaging the third coupling of the first zone to position a packer element of the tool adjacent to a ported housing that permits selective communication to the first zone.

31. The method of claim 27, wherein positioning the tool to permit the treatment of the first zone further comprises moving the tool to the fourth coupling of the first zone and engaging the fourth coupling of the first zone to position a packer element of the tool adjacent to a ported housing that permits selective communication to the first zone.

32. The method of claim 27, wherein positioning the tool to permit the treatment of the first zone further comprises moving the tool to position a packer element of the tool adjacent to a ported housing that permits selective communication to the first zone.

33. The method of claim 27, wherein the first indication, the second indication, the third indication, and the fourth indication are force indications at the surface.

34. The method of claim 27 further comprising:

moving the tool up the casing string to a second zone in the horizontal wellbore;

engaging a first coupling of the second zone with the portion of the tool; pulling the tool into the first coupling of the second zone, wherein pulling the tool into the first coupling of the second zone provides an indication at the surface; engaging a second coupling of the second zone with the portion of the tool; pulling the tool into the second coupling of the second zone, wherein pulling the tool into the second coupling of the second zone provides an indication at the surface; engaging a third coupling of the second zone with the portion of the tool; pulling the tool into the third coupling of the second zone, wherein pulling the tool into the third coupling of the second zone provides an indication at the surface;

engaging a fourth coupling of the second zone with the portion of the tool; pulling the tool into the fourth coupling of the second zone, wherein pulling the tool into the fourth coupling of the second zone provides an indication at the surface; and treating the second zone.

35. The method of claim 34 further comprising positioning the tool to permit the treatment of the second zone prior to treating the second zone.

36. The method of claim 34, wherein a distance between the first and second couplings of the second zone, a distance between the second and third couplings of the second zone, and a distance between the third and fourth couplings of the second zone are each 8 meters or less.

37. A method for treating multiple zones within a horizontal wellbore, the method comprising:

moving a tool up a casing string to a first zone in the horizontal wellbore, the casing string including a plurality of downhole casing segments each extending downhole of the first zone toward a separated downhole zone of the horizontal well, each being connected at both ends to downhole couplings, and each exhibiting a same distance between their respective downhole couplings;

engaging the downhole couplings with a mechanical casing collar location CCL connected to a bottom hole assembly (BHA) connected to coiled tubing;

pulling the mechanical CCL into the downhole couplings, wherein pulling the mechanical CCL into the downhole couplings provides indications at a surface revealing the distance between the downhole couplings;

engaging a first coupling of the first zone with the mechanical CCL, the first coupling of the first zone being connected via premium threads to a first end of a ported housing of the first zone;

pulling the mechanical CCL into the first coupling of the first zone, wherein pulling the mechanical CCL into the first coupling of the first zone provides a first indication at the surface;

engaging a second coupling of the first zone with the mechanical CCL, the second coupling of the first zone being connected via premium threads to a second end of the ported housing of the first zone and to a first end of a tubular;

pulling the mechanical CCL into the second coupling of the first zone, wherein pulling the mechanical CCL into the second coupling of the first zone provides a second indication at the surface revealing a distance between the first coupling and the second coupling;

engaging a third coupling of the first zone with the mechanical CCL, the third coupling of the first zone being connected via premium threads to a second end of the tubular;

pulling the mechanical CCL into the third coupling of the first zone, wherein pulling the tool into the third coupling of the first zone provides a third indication at the surface revealing a distance between the second coupling and the third coupling, such that the distance between the first and second coupling and the distance between the second and third coupling are both at least one meter less than the distance between the respective downhole couplings of each of the plurality of downhole casing segments and provide two consecutive distances that, using the mechanical CCL, are distinct from the distance between the respective downhole couplings;

determining a position of the tool in the casing string with respect to the ported housing using the two consecutive distances;

positioning the (BHA) to permit the treatment of the first zone using the ported housing; and treating the first zone.

* * * * *